United States Patent [19]

LaFleur et al.

[11] Patent Number: 4,790,029

[45] Date of Patent: Dec. 6, 1988

[54] COLLAPSIBLE BAG WITH SQUARE ENDS FORMED BY TRIANGULAR PORTIONS

[75] Inventors: Arthur E. LaFleur; Arnie LaFleur; Lee LaFleur, all of Manistee, Mich.

[73] Assignee: Custom Packaging Systems, Inc., Manistee, Mich.

[21] Appl. No.: 58,924

[22] Filed: Jun. 5, 1987

[51] Int. Cl.[4] ..... B65D 30/04; B65D 33/14; B65D 33/16; B65D 33/36

[52] U.S. Cl. ..... 383/24; 383/36; 383/41; 383/67; 383/121; 383/117; 383/904; 383/906; 222/105; 222/181; 222/185

[58] Field of Search ..... 383/6, 7, 8, 24, 32, 383/36, 41, 67, 117, 120, 121, 125, 126, 904, 906, 17, 42; 222/105, 181, 185

[56] References Cited

U.S. PATENT DOCUMENTS

| | | | |
|---|---|---|---|
| 3,119,548 | 1/1964 | Cook et al. | 383/121 |
| 3,961,743 | 6/1976 | Hollowell | 383/120 X |
| 4,136,723 | 1/1979 | Skaadel et al. | 383/7 |
| 4,244,970 | 9/1980 | Williamson et al. | 383/41 X |
| 4,479,243 | 10/1984 | Derby et al. | 383/121 X |
| 4,584,705 | 4/1986 | Myklebust et al. | 383/121 X |
| 4,596,040 | 6/1986 | LaFleur et al. | 383/42 X |

FOREIGN PATENT DOCUMENTS

| | | | |
|---|---|---|---|
| 1696 | 5/1979 | European Pat. Off. | 383/17 |
| 30641 | 3/1960 | Finland | 383/121 |
| 1525870 | 5/1968 | France | 383/904 |

*Primary Examiner*—William Price
*Assistant Examiner*—Sue A. Weaver
*Attorney, Agent, or Firm*—Barnes, Kisselle, Raisch, Choate, Whittemore & Hulbert

[57] ABSTRACT

A collapsible bag and method of making it from blanks of a flexible material which are cut from an elongate web substantially without wasting any material between adjacent blanks. Each blank has a circumferentially continuous central portion and four substantially identical isosceles triangular portions at each end of the blank. Adjacent sides of adjacent triangular portions are connected together to provide, when the bag is expanded or filled, generally square ends which are interconnected by generally rectangular side walls. An access opening is provided in an end of the bag by terminating the connections of its triangular portions short of their apexes. Preferably, a spout is received in the access opening and connected to the triangular portions.

12 Claims, 3 Drawing Sheets

FIG. 13
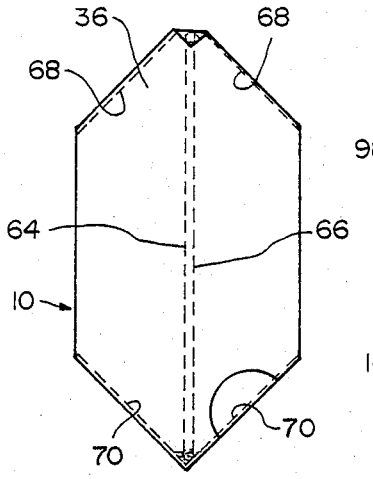
FIG. 14
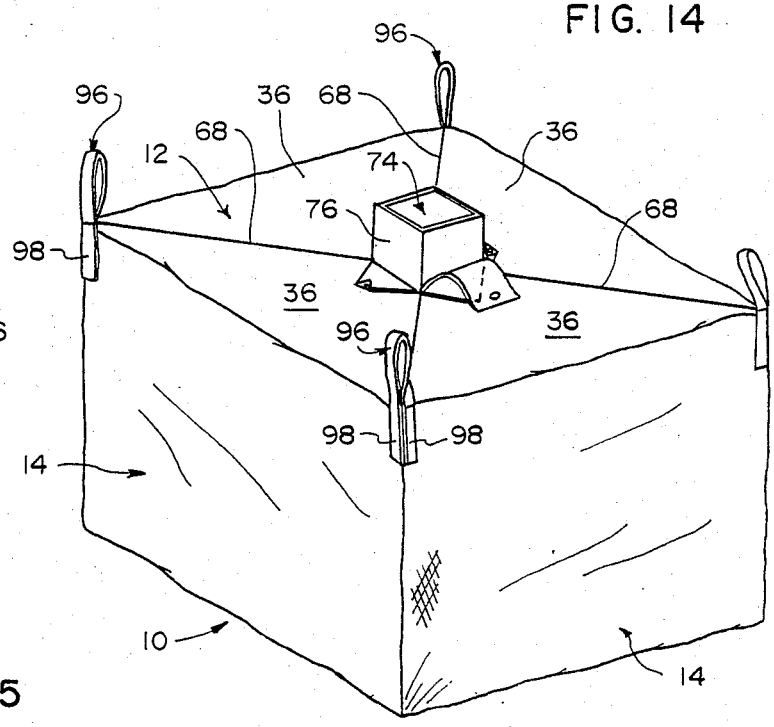
FIG. 15
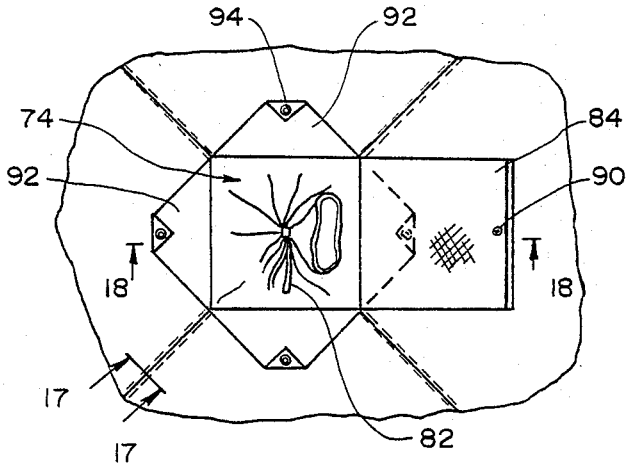
FIG. 16
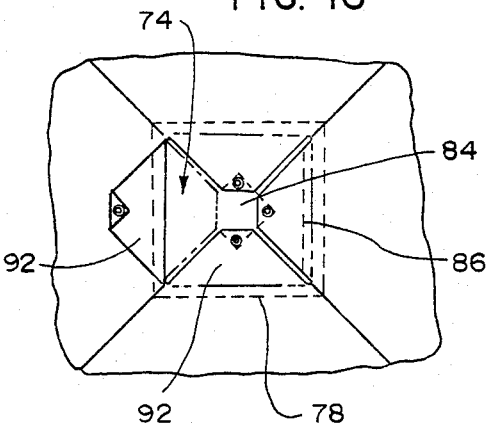
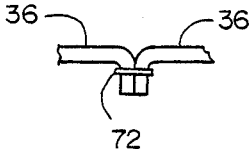
FIG. 17
FIG. 18
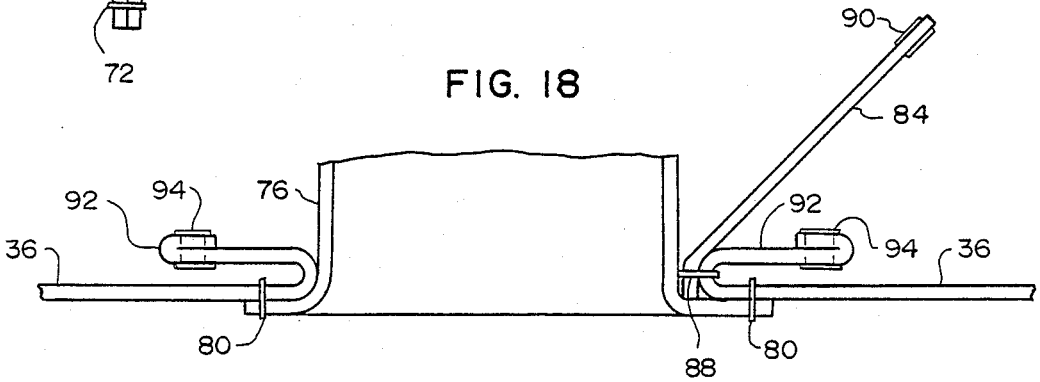

COLLAPSIBLE BAG WITH SQUARE ENDS FORMED BY TRIANGULAR PORTIONS

FIELD OF THE INVENTION

This invention relates to shipping and storage containers and more particularly to a collapsible container in the form of a bag of a flexible material and a method of making it.

BACKGROUND OF THE INVENTION

Previously, many granular products and some liquids have been shipped and stored in large bulk bags, which may contain as much as a ton or more of material. Some of these bulk bags are flexible and when empty can be folded to a generally flat condition. One such flexible bag is disclosed and claimed in U.S. Pat. No. 4,596,040.

These flexible bags have generally rectangular ends interconnected by generally rectangular side walls and when filled can be stacked one on top of another. For some applications, preferably the bags are made of a woven fabric and for other applications, a plastic material. For some applications, and particularly for storing liquids, a bag of a water impervious plastic material is received in and reinforced and protected by a bag of a woven fabric. Usually, these bags have a spout in one or both ends for filing and emptying the bags.

While these bags are generally satisfactory for a wide variety of applications, their design and construction is such that there is a substantial amount of flexible material wasted in making these bags. Indeed, to make such a bag having a capacity of about one cubic yard requires something in excess of eight square yards of flexible material of which more than two square yards or 25% is wasted in making the bag.

Relatively small flexible plastic bags having either an open end such as a conventinal shopping bag or a neck adjacent one and to facilitate packing soft ice cream and the like, are shown in prior art U.S. Pat. No. 3,119,548. A substantial amount of flexible plastic material is wasted in making the bags disclosed in this patent.

SUMMARY OF THE INVENTION

In accordance with this invention, collapsible bags are produced from an elongate web of flexible material which is severed to produce a plurality of substantially identical blanks with little if any waste material between adjacent blanks. When filled, the bags of this invention have substantially square ends interconnected by four generally rectangular side portions which are all part of the same blank of flexible material and when empty can be folded into a flat and compact arrangement having a pair of overlying panels of generally hexagonal configuration with a pair of folded gusseted panels received therebetween.

Each blank has a central portion and four generally triangular portions adjacent each end of the central portion and integral therewith. The sides of each triangular portion extend from the central portion toward the apex of the triangular portion. The adjacent sides of adjacent triangles are connected together adjacent their edges along a line extending from the central portion at least onethird and usually at least one half of the distance toward their associated apexes to provide, when the bag is filled, generally opposed ends having a substantially square configuration with four generally rectangular side panels extending therebetween. To provide a circumferentially continuous tubular blank, either the sides of the blank are connected together after it is severed from the web, or preferably, the sides of the web are connected together before the blanks are severed from it or the blanks are severed from a seamless tubular web.

To provide an access opening through an end at generally the center thereof, the lines of connection of the triangular portions are terminated short of their apexes. Where an access opening is desired in only one end of the bag, preferably the lines of connection of the triangular portions of the other end are extended substantially to their associated apexes to provide a permanently closed end without an access opening therethrough.

Preferably, a spout is provided for each opening. Preferably, each spout has a separate tubular piece of flexible material connected adjacent one end to the triangular portions associated with the opening along a line of connection which extends substantially and preferably completely around the periphery of the spout. If desired, flaps which can at least partially cover the opening, may be provided by the part of each of its associated triangular portions which extends beyond the points of termination of its associated lines of connection. Preferably, grommets are provided adjacent the apex of such parts to facilitate securing the flaps together. If desired, the access opening can also be covered by a flap of a flexible material which is preferably connected to one of the triangular portions.

Objects, features and advantages of this invention are a collapsible bag and method of making it which greatly reduces and substantially eliminates all wasted material, produces highly accurate severing of blanks for bags and close dimensional control of bags, greatly simplifies and facilitates severing blanks for bags from a continuous web, is readily and easily adapted to the mass production of bags, and is of relatively simple, economical and reliable manufacture of bags.

BRIEF DESCRIPTION OF THE DRAWINGS

These and other objects, features and advantages of this invention will be apparent from the following detailed description, appended claims, and accompanying drawings in which:

FIG. 13 is a plan view of a bag embodying this invention when collapsed;

FIG. 14 is a perspective view of the bag of FIG. 13 when expanded and with its spout open;

FIG. 15 is a fragmentary plan view of the expanded bag of FIG. 14 with the spout tied and flaps open;

FIG. 16 is a fragmentary view of the expanded bag of FIG. 14 with the spout closed off and tucked into the bag and some of its flaps overlying the opening; and FIGS. 17 and 18 are fragmentary sectional views taken generally on lines 17—17 and 18—18 respectively of FIG. 15.

DETAILED DESCRIPTION

For application where containers or bags of great strength are needed, they may be made from a woven fabric material, such as woven polyethylene and woven polypropylene fabrics. For other applications where less strength is needed, or a leak-proof container is required, the bags may be made from a plastic film, such as polyethylene and polypropylene plastic films with a thickness in the range of about 4 to 10 mil. If a leak-proof and high strength container is required, a bag of a plastic film can be received in a bag of a woven fabric with both bags having the same configuration.

In accordance with this invention, collapsible containers or bags 10 (FIGS. 13 & 14) are made from blanks which are cut or severed from an elongate web of a flexible material. Each bag when expanded or filled has a pair of generally square ends 12 interconnected by four generally rectangular side walls 14.

A plurality of substantially identical blanks are severed or cut from a web without wasting any material between adjacent blanks. The blanks have a tubular or circumferentially continuous central portion and four triangular portions adjacent each end which are integral with the central portion. The triangular portions form generally square ends of the bag and the central portion forms four side walls. The triangular portions are substantially identical isosceles triangles each with a substantially 90° angle at its apex and a pair of substantially 45° acute angles. Each side wall has a width of about $\frac{1}{4}$ of the circumference of the tubular blank and each triangular portion has a height of about $\frac{1}{2}$ of the width of a side wall or $\frac{1}{8}$ of the circumference of the tubular blank.

Figure 1:
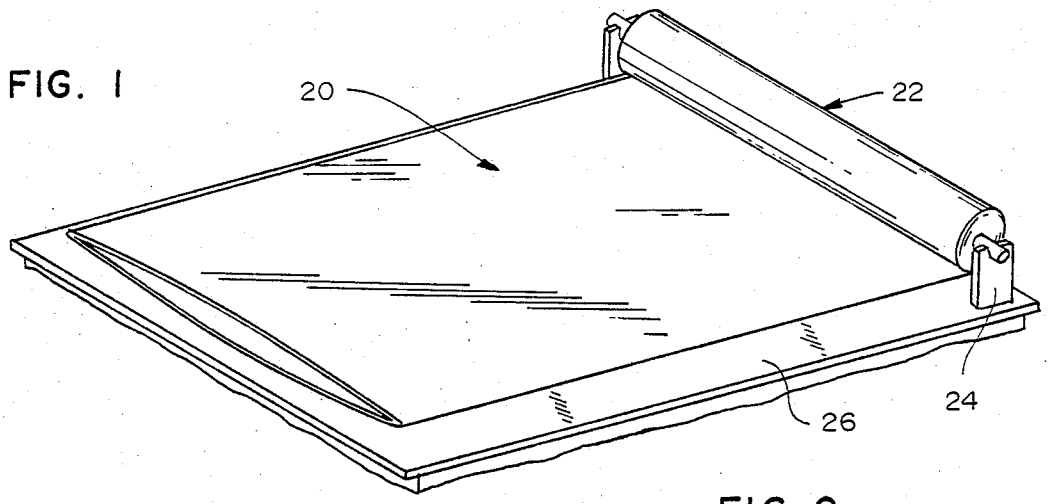
FIG. 1 is a perspective view of a dispenser for and a roll of a continuous web of material for making a plurality of blanks for bags in accordance with this invention.

If desired, blanks can be cut from an elongate sheet of a single layer of flexible material and then their side edges connected or jointed together to provide a tubular blank. However, as shown in FIG. 1, preferably the blanks are cut from a tubular web 20 which is circumferentially continuous. Preferably, the tubular web is seamless, although it can be formed by connecting or joining together the side edges of an elongate sheet of flexible material, such as by stiching a woven fabric or heat sealing a plastic film. To facilitate handling the elongate web, preferably, it is in the form of a roll 22 which can be supported for rotation by yokes 24 on a work table 26.

Figure 2:
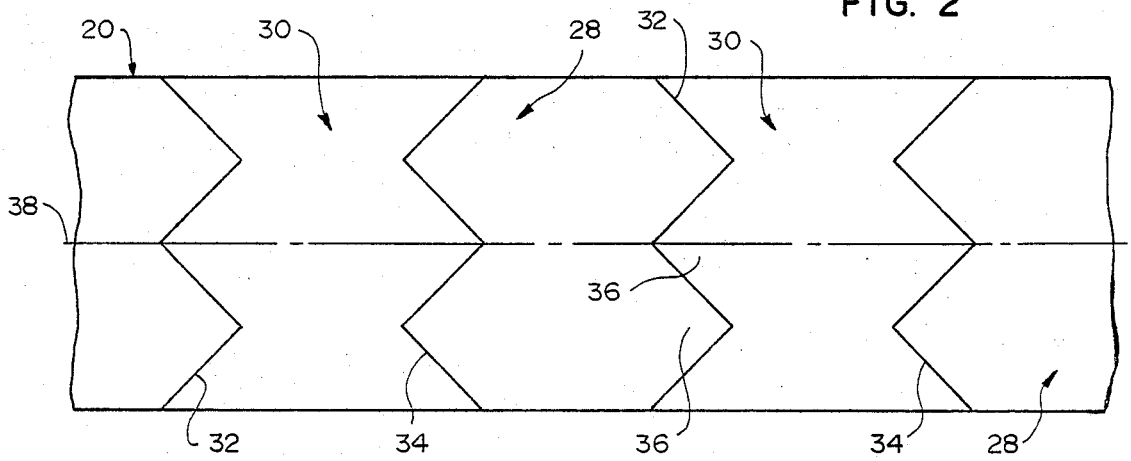
FIG. 2 is a fragmentary plan view of the web of material with severing lines thereon for cutting a plurality of blanks from web in accordance with this invention.

As shown in FIG. 2, a plurality of blanks 28 and 30 may be formed from the web 20, without any scrap, by cutting or severing the web along the zig zag lines 32 and 34 which extend around the periphery of the tubular web. To form four substantially identical isosceles triangular portions 36 on each end of each blank, each segment of the lines 32 and 34 is of the same length and inclined at an acute included angle of substantially 45° to the longitudinal axis 38 of the web. Adjacent segments of each of the lines 32 and 34 form an apex of a triangular portion and are at substantially a right angle to each other.

Figure 3:
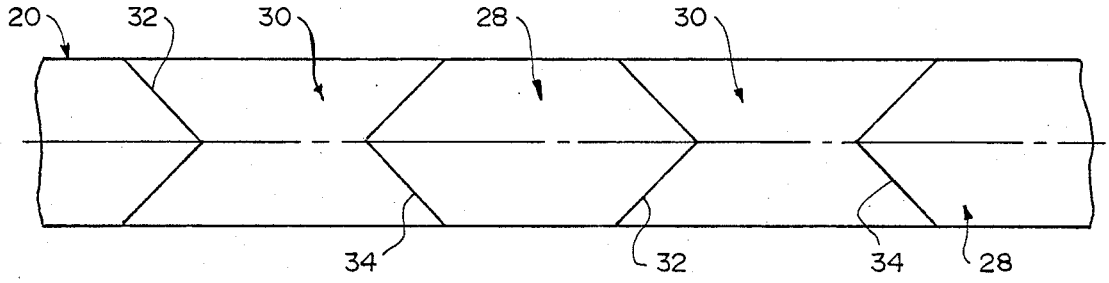
FIG. 3 is a fragmentary plan view of the web of FIG. 2 after it has been folded once about its longitudinal axis to simplify cutting the blanks.
Figure 4:
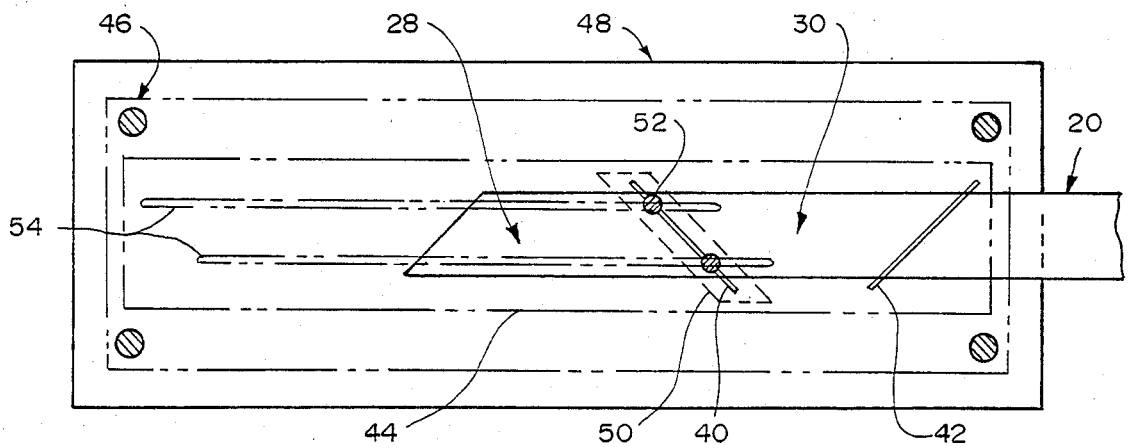
FIG. 4 is a fragmentary plan view of the blank of FIG. 3 after it has been folded twice to further simplify cutting the blanks and received in a severing apparatus.

To simplify cutting the web and improve the accuracy of the cut blanks, it is desirable to fold the web once, as shown in FIG. 3, and preferably twice, as shown in FIG. 4. If the tubular web is folded over itself once, as shown in FIG. 3, it will have four layers of material which can be cut at the same time along the generally V-shaped segments of lines 32 and 34. If the tubular web is folded over itself twice, as shown in FIG. 4, there will be eight layers of material which can be cut at the same time along a straight segment of the lines 32 and 34.

As shown in FIG. 4, when the web has been folded twice, it can be readily severed or cut by straight knife edges 40 and 42 carried by a movable upper platen 44 of a fixture 46 received in a conventional press 48. To facilitate cutting blanks of various lengths, preferably the blade 40 is received in an adjustable holder 50 which can be moved longitudinally of the platen relative to the blade 42 and secured in a position to cut blanks of the desired length by the locking screws 52 received in slots 54 in the upper platen. The twice folded web 20 is advanced through the fixture a distance equal to twice the desired length of the blanks so that with each cycle of the press the knife edges cut two blanks from the web (one blank 28 and one blank 30).

Figure 11:
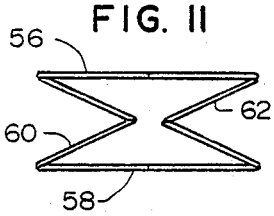
Figure 12:
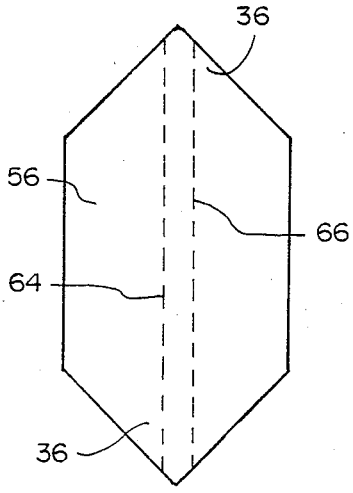
FIG. 12 illustrates a blank folded into a configuration having a pair of generally flat and overlying panels of generally hexagonal shape with a pair of folded gusseted panels received therebetween.

Preferably, although not necessarily, to facilitate connecting together adjacent side edges of adjacent triangular portions of the blanks to form the collapsible bag, the blanks 28 and 30 as cut from the web are rearranged and refolded into the generally collapsed configuration shown in FIG. 12. In this collapsed configuration each blank has a pair of generally flat overlying trapezoidal shaped panels 56 and 58 with a pair of folded gusseted panels 60 and 62 (FIG. 11) received therebetween.

Figure 5:
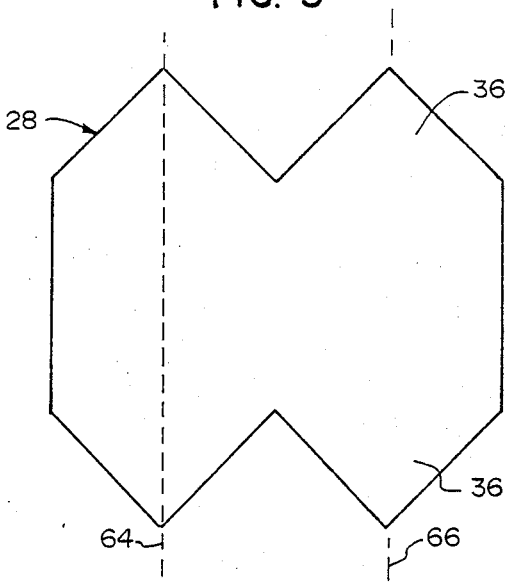
FIGS. 5 and 6 are plan views of adjacent substantially identical blanks as severed from the web.
Figure 6:
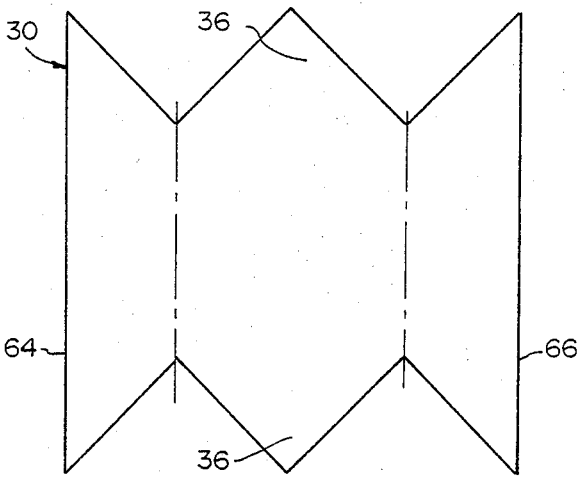
Figure 7:
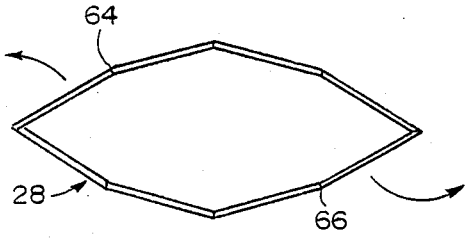
FIG. 7 is an end view of the blank of FIG. 5 as severed from the web.
Figure 8:
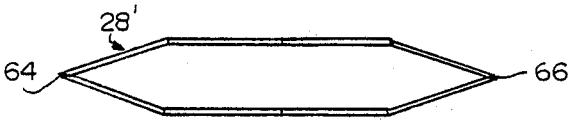
FIGS. 8 and 9 are end and plan views respectively of the blank of FIG. 5 after its material has been rotated circumferentially through an arc of about 45° so that it has the same orientation as the blank of FIG. 6.
Figure 9:
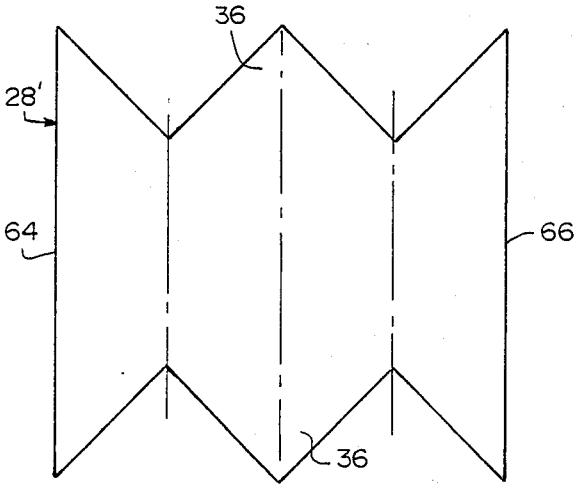

Preferably, the blanks 28 are first reoriented from the configuration shown in FIG. 5 to the configuration shown in FIG. 9. This is accomplished by circumferentially rotating the material of the tubular blank 28 through an arc of about 45° as shown by a comparison of FIGS. 5 and 7 with FIGS. 8 and 9, so that the reoriented blank 28' has two layers of material with folds along the lines 64 and 66, the location of which is indicated by phantom lines in FIG. 5. After the blank 28 has been so folded, it has the same configuration as that of the blank 30.

Figure 10:
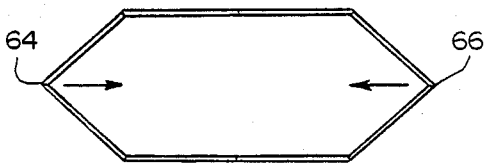
FIGS. 10 and 11 are end views illustrating folding of the blanks of FIGS. 6 and 9 into the configuration of FIG. 12.

Preferably, all the blanks 28' and 30 are refolded into the configuration of FIG. 12 to facilitate making the bags. As shown in FIGS. 10 and 11, the blanks are refolded by moving the fold lines 64 and 66 inwardly so they lie adjacent each other to thereby rearrange each blank so it has overlying hexagonal shaped panels 56 and 58 with gusseted panels 60 and 62 therebetween.

To provide generally square ends when the bag is expanded, the adjacent side edges of adjcent triangular portions 36 are jointed or connected together along lines of connection 68 and 70 as shown in FIGS. 13 and 14. If the blank is made of a woven fabric material, preferably the triangular portions are connected together along the lines 68 and 70 by a series of stitches 72 (FIG. 17) with a suitable thread and if the material is a plastic film preferably by heat sealing the triangular portions together along the connecting lines.

An access opening 74 is provided in at least one end of the bag. Preferably, the access opening is formed by terminating the lines of connection 68 or 70 short of the apexes of their associated triangular portions which forms a four sided and, if desired, substantially square opening adjacent the center of the end of the bag. The lines of connection extend at least one third, usually at least one half, and after at least three-fourths of the distance from the central position to the apexes of their associated triangular portions. If desired, another access opening can also be formed in the other end of the bag by terminating the lines of connection short of the apexes of its associated triangular portions. If no opening is desired in an end of the bag, its lines of connection can be extended to substantially the apexes of their associated triangular portions.

Preferably, a spout 76 is provided in the access opening. Preferably, the spout is a separate circumferentially continuous tube of the same material as the blank of the bag. As shown in FIGS. 16 and 18, one end of the spout is inserted in the opening 74 and connected to the associated triangular portions along a generally rectangular line of connection 78, such as by a series of stiches 80. As shown in FIG. 15, the spout can be closed off and secured by a cord 82 tied around it.

If desired, the spout can be covered by a flap 84 of flexible material which is connected to one of the triangular portions along the line 86 such as by stiches 88. If desired, a grommet 90 can be provided in the flap to facilitate securing it. Sometimes it is desirable to secure the flap 84 in a position spaced from the spout so that it will not interfere with material flowing out of the spout when emptying the bag. If desired, flaps for covering the opening 74 can be provided by the parts 92 of the triangular portions extending beyond their lines of connection. Preferably, to facilitate securingthese flaps, they are provided with grommets 94 adjacent their apexes through which a cord can be laced and tied.

If desired, straps 96 can be provided for lifting and moving the bag. Preferably, each strap is in the form of a loop of a flexible material with its legs 98 connected to the central portion of the blank of the bag adjacent the corners of an end of the bag. Preferably, each leg of each strap is connected to the bag, such as by a series of stitches.

As shown in FIG. 14, when the bag is filled, it assumes a generally rectangular or cubical configuration with generally square ends 12 formed by the triangular portions 36 and four interconnecting side walls 14 each of which is generally rectangular. This provides a filled bag which can be stacked. When the bag is empty, it can be collapsed and folded into the generally flat configuration, shown in FIG. 13, with a pair of overlying generally hexagonal shaped panels 56 and 58 with folded gusseted panels 60 and 62 received therebetween. This provides a generally flat and compact configuration for shipment and storage of the bag when empty.

We claim:

1. A collapsible bag which when filled has a pair of spaced apart ends each being generally square with four side wall portions extending therebetween, which comprises; a tubular blank of one piece of flexible material having a circumferentially continuous central portion and four substantially identical isosceles triangular portions adjacent each end, each triangular portion having a pair of sides extending from the central portion toward an apex of the triangular portion, said sides of each triangle being essentially at a right angle to each other, connector means connecting together adjacent sides of adjacent triangular portions adjacent their edges along lines of connection extending from at least closely adjacent the central portion toward their associated apexes at least three-fourths of the distance therebetween, and the lines of connection associated with the triangular portions adjacent at least one end of the central portion terminating short of their apexes so as to at least in part define an access opening therethrough adjacent the center of the generally square end defined by such triangular portions when such bag is expanded such that when filled such bag has a pair of spaced apart and substantially square and flat ends interconnected by four generally rectangular side walls and when empty can be collapsed into a compact configuration having a pair of overlying panels with a generally hexagonal shape with a pair of folded gusseted panels received therebetween with the fold line between adjacent gusseted panels extending between substantially the apexes of their associated opposed triangular portions and the fold lines lying closely adjacent each other, a tubular spout which is circumferentially continuous and of a separate piece of flexible material, said spout being disposed in such central access opening with an end portion of each triangular portion defining such central access opening overlapping said spout, and connector means connecting said tubular spout to said triangular portion at least substantially around the periphery of said spout.

2. The collapsible bag of claim 1 wherein at the other end of said blank each line of connection of adjacent sides of adjacent triangular portions extends substantially to their apexes so as to provide a completely closed other end of the bag of said blank.

3. The collapsible bag of claim 1 which also comprises a flap of a flexible material constructed and arranged to removably overlie the central opening in which said spout is disposed and at least in part to underlie at least a portion of the part of at least one of the triangular portions extending beyond the line of connection of such triangular portions to said spout, and connector means connecting said flap to said part of such one triangular portion.

4. The collapsible bag of claim 1 which also comprises at least two straps of a flexible material each forming a lifting loop having a pair of runs, and both runs of each strap being connected to the central portion of said blank so the loops are adjacent diagonally opposed corners of one of the generally square ends formed by the triangular portions of said blank.

5. The collapsible bag of claim 1 which also comprises four straps each of a separate piece of flexible material forming a lifting loop having a pair of runs, and both runs of each strap being connected to the central portion of said blank so as to provide a lifting loop adjacent each of the four corners of one of the generally square ends formed by the triangular portions of said blank.

6. The collapsible bag of claim 1 wherein such flexible material is a plastic material, and such connections comprise heat seals extending along such lines of connection.

7. The collapsible bag of claim 1 wherein such flexible material is a fabric material and such connections comprise a series of stiches of thread extending along such lines of connection.

8. The collapsible bag of claim 1 wherein such flexible material is a woven fabric material.

9. The collapsible bag of claim 1 wherein such flexible material is a plastic material.

10. A collapsible bag which when filled has a pair of spaced apart ends each being generally square with four side wall portions extending therebetween, which comprises; a tubular blank of one piece of flexible material having a circumferentially continuous central portion and four substantially identical isosceles triangular portions adjacent each end, each triangular portion having a pair of sides extending from the central portion toward an apex of the triangular portion, said sides of each triangle being substantially at a right angle to each other, connector means connecting together adjacent sides of adjacent triangular portions adjacent their edges along lines of connection extending from at least closely adjacent the central portion toward their associated apexes at least three-fourths of the distance therebetween, the lines of connection associated with the triangular portions adjacent at least one end of the central portion terminating short of their apexes so as to at least in part define an access opening therethrough adjacent the center of the generally square end defined by such triangular portions when such bag is expanded such that when filled such bag has a pair of spaced apart and substantially square ends interconnected by four generally rectangular side walls and when empty can be collapsed into a compact configuration having a pair of overlying panels with a generally hexagonal shape and a pair of folded gusseted panels received therebetween, a tubular spout which is circumferentially continuous and of a separate piece of flexible material, said spout being disposed in such central access opening with an end portion of each triangular portion defining such central access opening overlapping said spout, connector means connecting said tubular spout to such triangular portions at least substantially around the periphery of said spout and spaced from the apexes of such triangular portions such that the parts of such triangular portions extending beyond such connector means provide flaps which can be disposed to at least in part overlie such spout.

11. A collapsible bag which when filled has a pair of spaced apart ends each being generally square with four side wall portions extending therebetween, which comprises a tubular blank of one piece of flexible material having a circumferentially continuous central portion and four substantially identical isosceles triangular portions adjacent each end, each triangular portion having a pair of sides extending from the central portion toward an apex of the triangular portion, said sides of each triangle being substantially at a right angle to each other, connector means connecting together adjacent sides of adjacent triangular portions adjacent their edges along lines of connection extending from at least closely adjacent the central portion toward their associated apexes at least three-fourths of the distance therebetween, the lines of connection associated with the triangular portions adjacent at least one end of the central portion terminating short of their apexes so as to at least in part define an access opening therethrough adjacent the center of the generally square end defined by such triangular portions when such bag is expanded such that when filled such bag has a pair of spaced apart and substantially square ends interconnected by four generally rectangular side walls and when empty can be collapsed into a compact configuration having a pair of overlying panels with a generally hexagonal shape and a pair of folded gusseted panels received therebetween, a tubular spout which is circumferentially continuous and of a separate piece of flexible material, said spout being disposed in such central access opening with an end portion of each triangular portion defining such central access opening overlapping said spout, connector means connecting said tubular spout to such triangular portions at least substantially around the periphery of said spout and spaced from the apexes of such triangular portions such that parts of such triangular portions extending beyond such connector means provide flaps which can be disposed to at least in part overlie such spout, and a grommet in each triangular portion associated with said spout adjacent the apex thereof and spaced from such line of connection of said spout to its associated triangular portions.

12. A collapsible bag which when filled has a pair of spaced apart ends each being generally square with four side wall portions extending therebetween, which comprises; a tubular blank of one piece of flexible material having a circumferentially continuous central portion and four substantially identical isosceles triangular portions adjacent each end, each triangular portion having a pair of sides extending from the central portion toward an apex of the triangular portion, said sides of each triangle being substantially at a right angle to each other, connector means connecting together adjacent sides of adjacent triangular portions adjacent their edges along lines of connection extending from at least closely adjacent the central portion toward their associated apexes at least three-fourths of the distance therebetween, and the lines of connection associated with the triangular portions adjacent both ends of the central portion terminating short of their apexes so as to at least in part define an access opening therethrough adjacent the center of the generally square end defined by such triangular portions when such bag is expanded such that when filled such bag has a pair of spaced apart and substantially square ends interconnected by four generally rectangular side walls and when empty can be collapsed into a compact configuration having a pair of overlying panels with a generally hexagonal shape with a pair of folded gusseted panels received therebetween, a first tubular spout and a second tubular spout each being circumferentially continuous and of a separate piece of flexible material, said first spout being disposed in the central access opening in one end of said blank with an end portion lapping the triangular portions of such one end and connector means connecting said first spout to such triangular portions along a line of connection extending at least substantially around the periphery of said first spout, said second spout being disposed in the central access opening in the other end of said blank with an end portion lapping the triangular portions of said other end and connector means connecting said second spout to such triangular portions along a line of connection extending at least substantially around the periphery of said second spout.

* * * * *